US007806393B2

(12) United States Patent
Hara et al.

(10) Patent No.: US 7,806,393 B2
(45) Date of Patent: Oct. 5, 2010

(54) CLAMP APPARATUS

(75) Inventors: Koji Hara, Tsukubamirai (JP); Kouichirou Kanda, Tsukuba (JP)

(73) Assignee: SMC Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/246,537

(22) Filed: Oct. 7, 2008

(65) Prior Publication Data

US 2009/0108513 A1 Apr. 30, 2009

(30) Foreign Application Priority Data

Oct. 31, 2007 (JP) ..... 2007-282569

(51) Int. Cl.
*B25B 5/12* (2006.01)

(52) U.S. Cl. ..... 269/32; 269/228; 269/24; 294/88; 294/116

(58) Field of Classification Search ..... 269/32, 269/24–27, 34, 228; 294/88, 116; 324/207.16
See application file for complete search history.

(56) References Cited

U.S. PATENT DOCUMENTS

| | | | | |
|---|---|---|---|---|
| 5,503,378 | A * | 4/1996 | Schauss et al. | 269/32 |
| 6,364,300 | B1 * | 4/2002 | Kita | 269/32 |
| 6,641,189 | B2 * | 11/2003 | Moilanen et al. | 294/88 |
| 6,666,489 | B2 * | 12/2003 | Kruger | 294/88 |
| 7,032,944 | B2 * | 4/2006 | Moilanen et al. | 294/88 |
| 7,602,174 | B2 * | 10/2009 | Holcomb et al. | 324/207.16 |
| 2003/0197389 | A1 * | 10/2003 | Moilanen et al. | 294/88 |
| 2005/0242482 | A1 * | 11/2005 | Nakata et al. | 269/32 |
| 2006/0163790 | A1 * | 7/2006 | Xu et al. | 269/32 |
| 2008/0018124 | A1 * | 1/2008 | Waldorf et al. | 294/116 |
| 2008/0101895 | A1 * | 5/2008 | Holcomb et al. | 414/226.02 |
| 2008/0217939 | A1 * | 9/2008 | Jenkins et al. | 294/116 |
| 2008/0237957 | A1 * | 10/2008 | Waldorf | 269/27 |
| 2009/0108513 | A1 * | 4/2009 | Hara et al. | 269/89 |

FOREIGN PATENT DOCUMENTS

| | | |
|---|---|---|
| DE | 60 2004 006 647 T2 | 1/2008 |
| JP | 60-17928 | 2/1985 |
| JP | 02-167641 | 6/1990 |
| JP | 11-138372 | 5/1999 |
| WO | WO 2008/011209 A1 | 1/2008 |

* cited by examiner

*Primary Examiner*—Lee D Wilson
(74) *Attorney, Agent, or Firm*—Oblon, Spivak, McClelland, Maier & Neustadt, L.L.P.

(57) ABSTRACT

A clamp apparatus is equipped with a cylinder mechanism having a piston. A driving force of the cylinder mechanism is transmitted to a clamp arm, which is retained on a housing through a block body and a link pin that make up a driving force transmitting mechanism, the clamp arm being rotated through a predetermined angle. The block body includes a rotatably supported roller. The block body is guided along an axial direction by displacement of the roller, while the roller is rotated along a guide member of the housing.

14 Claims, 5 Drawing Sheets

CLAMP APPARATUS

BACKGROUND OF THE INVENTION

1. Field of the Invention

The present invention relates to a clamp apparatus, which is capable of clamping a workpiece via a rotatable clamp arm that is rotated through a predetermined angle under a displacement operation of a piston.

2. Description of the Related Art

Heretofore, for example, when constituent parts of an automobile or the like are welded, a clamp apparatus has been used for clamping the parts.

The clamp apparatus, for example as disclosed in U.S. Pat. No. 5,503,378, comprises a main body equipped with a piston that is displaced under the supply of a pressure fluid, a pair of clamp arms which are retained rotatably with respect to the main body, and a toggle link mechanism through which a driving force from the main body is transmitted to the clamp arm. In addition, rotating rollers that make up part of the toggle mechanism are inserted into guide grooves formed respectively on both side surfaces of the main body. Moreover, the rollers are inserted through groove portions of the clamp arms, and the rollers are displaced along an axial direction upon displacement of the piston. As a result, the clamp arms are rotated by a predetermined angle about a support, and corresponding to the direction of rotation, a clamped state capable of clamping the workpiece, and an unclamped state in which the clamped condition is released, are switched.

However, with such a conventional technique, because a structure is provided made up from the pair of clamp arms, two rotating rollers are required along therewith, which engage with the clamp arms, and additionally, a pair of guide grooves in the main body through which the rollers are inserted, respectively, also are required. Further, because the guide grooves in which the rollers are guided are disposed directly in both side surfaces of the main body, a cover plate also is needed for the purpose of closing the guide grooves. As a result, the number of parts needed to construct the clamp apparatus increases, and the structure thereof is complex, which decreases the ease of assembly thereof when the clamp apparatus is manufactured.

SUMMARY OF THE INVENTION

A general object of the present invention is to provide a clamp apparatus, which is capable of reliably and smoothly carrying out a clamping operation on a workpiece, in which the structure of the clamp apparatus is simplified, and ease of assembly of the clamp apparatus is improved.

The present invention is directed to a clamp apparatus in which linear movement in a cylinder is converted into rotational movement for thereby clamping a workpiece with a clamp arm, the clamp apparatus comprising:

a main body;

a cylinder connected to the main body and having a piston therein which is displaced along an axial direction under a pressing action of a pressure fluid;

a clamp arm retained rotatably with respect to the main body; and a driving force transmitting mechanism for transmitting a driving force from the cylinder to the clamp arm and causing rotational displacement of the clamp arm, wherein the driving force transmitting mechanism comprises:

a displacement member, which is displaced along the axial direction together with the piston;

a guide body disposed on the displacement member and which abuts against a side surface of the main body; and a pin member disposed on the displacement member and which is inserted through a groove of the guide arm.

The above and other objects features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
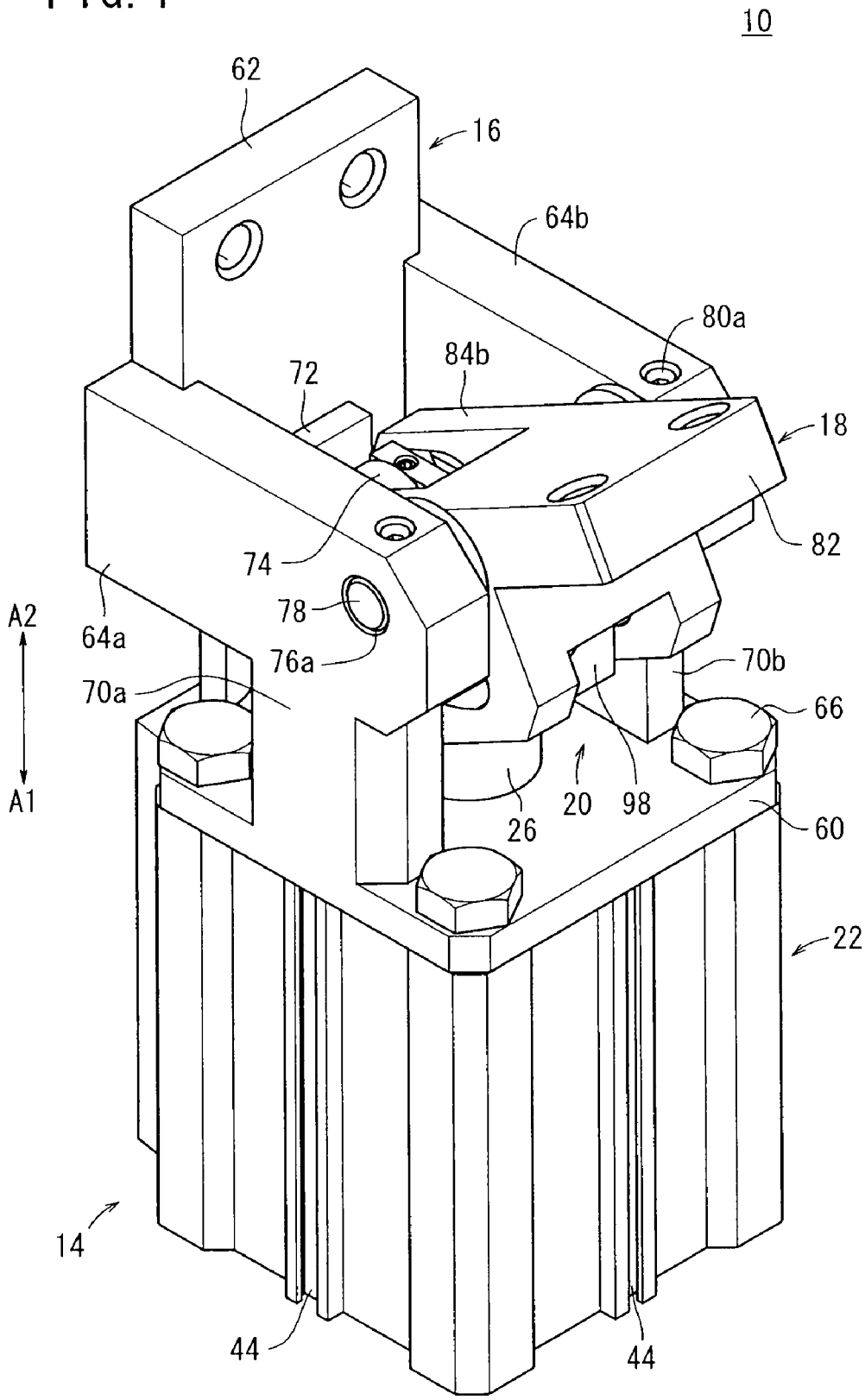
FIG. 1 is an exterior perspective view of a clamp apparatus according to an embodiment of the present invention.

In FIG. 1, reference numeral 10 indicates a clamp apparatus according to an embodiment of the present invention.

As shown in FIGS. 1 through 5, the clamp apparatus 10 includes a cylinder mechanism (cylinder) 14 with a piston 12 installed therein, a housing (main body) 16 connected to the cylinder mechanism 14, a clamp arm 18 that is retained rotatably with respect to the housing 16, and a driving force transmitting mechanism 20 that rotates the clamp arm 18 under a driving action of the cylinder mechanism 14.

The cylinder mechanism 14 comprises a cylinder tube 22 formed in a hollowed shape, the piston 12, which is disposed displaceably inside the cylinder tube 22, a head cover 24 that closes one end of the cylinder tube 22, and a rod cover 28 disposed at the other end side of the cylinder tube 22, which supports a piston rod 26 connected to the piston 12.

The cylinder tube 22 is formed with a rectangular shape in cross section and a cylinder hole 30 penetrates through the cylinder tube 22 along the axial direction thereof.

First and second ports 32, 34 for supplying and discharging a pressure fluid, are disposed on a side surface of the cylinder tube 22, which communicate with the cylinder hole 30 through respective communication passages 36*a*, 36*b*. The first and second ports 32, 34 are disposed with a predetermined separation therebetween along the axial direction (the direction of arrows A1 and A2) of the cylinder tube 22.

The piston 12 is installed inside the cylinder hole 30. A piston packing 38, a wear ring 40 and a magnet 42 are disposed via annular grooves, while being separated from each other at predetermined intervals on the outer circumferential surface of the piston 12. The piston packing 38 and the wear ring 40 are arranged in sliding contact with an inner wall surface of the cylinder tube 22. Further, a position detecting sensor (not shown) is disposed in a sensor groove 44 formed on a side surface of the cylinder tube 22. Magnetism from the magnet 42 is detected by means of the position detecting sensor, so that the displacement position of the piston 12 can be confirmed.

Further, a damper 46*a* is installed via an annular groove confronting the head cover 24 on one end surface of the piston 12. The damper 46*a* is made, for example, from an elastic material such as rubber or the like, for preventing the piston 12, at a displacement terminal end position thereof, from coming into direct contact with the head cover 24, and for buffering shocks.

On the other hand, a piston hole 48 that penetrates in the axial direction is formed in the center of the piston 12, through which the piston rod 26 is inserted. In addition, one end of the piston rod 26 is connected integrally onto one end surface side of the piston 12 by engagement in the piston hole 48.

A rod hole 50 through which the piston rod 26 is inserted is formed in the rod cover 28, and a damper 46*b* is installed via an annular groove in an end surface of the rod cover 28 confronting the piston 12. More specifically, the damper 46*b* prevents the other end surface of the piston 12 from coming into direct contact with the rod cover 28 and buffers shocks.

Further, a sealing ring 52 is installed in an outer circumferential surface of the rod cover 28, so that by abutment thereof against an inner wall surface of the cylinder tube 22, a fluidtight condition inside the cylinder hole 30 can be maintained. Furthermore, a rod packing 54 and a bush 56 are mounted via annular grooves in the rod hole 50. By abutment of the bush 56 against the outer circumferential surface of the piston rod 26, the piston rod 26 is supported for displacement along the axial direction (the direction of arrows A1 and A2).

The rod cover 28 is inserted from the other end side of the cylinder tube 22, and is affixed to the interior of the cylinder hole 30 by a ring 58, which engages with respect to the inner wall surface of the cylinder tube 22.

The housing 16 includes a base member 60 connected to the other end of the cylinder tube 22, a retaining member 62, which lies perpendicular with respect to the base member 60 and is capable of clamping a workpiece (not shown) therebetween with the clamp arm 18, and a pair of holders 64*a*, 64*b* that rotatably retain the clamp arm 18 therein.

The base member 60 is connected to the other end of the cylinder tube 22 through a plurality of bolts 66 and closes the other end of the cylinder tube 22. A through hole 68 through which the piston rod 26 is inserted is formed in the center of the base member 60.

The retaining member 62 is disposed at a right angle with respect to the end of the base member 60 and extends a predetermined height in a direction (the direction of the arrow A2) separating away from the base member 60. Specifically, the housing 16 is formed from the base member and the retaining member 62, substantially with an L-shape in cross section (see FIG. 2).

The holders 64*a*, 64*b* extend perpendicularly from a substantially center region along the axial direction of the retaining member 62, and are provided respectively on both sides of the retaining member 62. Further, legs 70*a*, 70*b* are disposed respectively between the holders 64*a*, 64*b* and the base member 60, and are connected to the base member 60. Specifically, the pair of holders 64*a*, 64*b* are disposed in parallel and are separated a predetermined distance with respect to the base member 60, whereas the pair of legs 70*a*, 70*b* are disposed substantially in parallel and are separated a predetermined distance with respect to the retaining member 62.

A guide member 72 that projects in the extending direction of the holders 64*a*, 64*b* is provided on a side surface of the retaining member 62. A roller (guide body) 74 making up part of the driving force transmitting mechanism 20 abuts against and is guided by the guide member 72. The guide member 72 expands outwardly at a predetermined height with respect to the side surface of the retaining member 62, the side surface thereof being formed in a flat planar shape. The guide member 72 further is formed with a predetermined width.

In the holders 64*a*, 64*b*, respective pin holes 76*a* are formed in ends thereof separated from the retaining member 62, and a support pin 78, which rotatably supports the clamp arm 18, is inserted through the pin holes 76*a*. The support pin 78 is affixed by a pair of fixing screws 80*a* threaded into the holders 64*a*, 64*b*, so that removal of the support pin 78 from the pin holes 76*a* is prevented.

The clamp arm 18 comprises a flat plate-shaped clamp 82 formed on one end side thereof, and a pair of yokes (forked pieces) 84*a*, 84*b* provided at the other end side, which fork in two branches with respect to an end of the clamp 82. Additionally, a hole 86 penetrates at a joint region between the clamp 82 and the yokes 84*a*, 84*b*, through which the support pin 78 is inserted. The hole 86 penetrates in a widthwise direction of the clamp arm 18. More specifically, the clamp arm 18 is rotatably supported on an inner portion of the housing 16 through the support pin 78, which is inserted through the hole 86 and supported in the housing 16 by the pin holes 76*a*.

The pair of yokes 84*a*, 84*b* extend respectively in directions perpendicular with respect to the clamp 82, and are disposed in parallel while being mutually separated by a predetermined distance. Link grooves 88*a*, 88*b* are formed that extend at a fixed width along the yokes 84*a*, 84*b*. Both ends of a link pin (pin member) 90 are inserted respectively into the link grooves 88*a*, 88*b* through respective collars 92. The link grooves 88*a*, 88*b* are formed in the same shape on one of the yokes 84*a* and the other of the yokes 84*b*, and include an arcuate shaped first link portion 94 that extends at a predetermined radius along a direction that separates with respect to the clamp 82, from one end on the side of the clamp 82, and a second link portion 96 that is formed at the other end that separates with respect to the clamp 82. The center and radius of the second link portion 96 differ with respect to the first link portion 94.

The clamp arm 18 is rotated until the clamp 82 becomes substantially parallel with the retaining member 62, and thereby is capable of clamping a workpiece between the clamp 82 and the retaining member 62.

The driving force transmitting mechanism 20 is constituted by a block body (displacement member) 98, which is disposed in a space of the housing 16 surrounded by the retaining member 62 and the holders 64*a*, 64*b* and connected to an end of the piston rod 26, the roller 74 that is rotatably supported on the block body 98, and the link pin 90, which is inserted through the link grooves 88*a*, 88*b*.

The block body 98 is formed with an elongate shape in cross section, with a rod bolt 102 that connects to the piston rod 26 via a bolt hole 100 being inserted through a center portion thereof, such that the block body 98 is connected to the other end of the piston rod 26 via the rod bolt 102. Specifically, the block body 98 is disposed displaceably along the axial direction (the direction of arrows A1 and A2) together with the piston 12 and the piston rod 26, under a displacement action of the cylinder mechanism 14.

Further, the block body 98 includes a cutout portion, which is recessed in a concave form on one end part thereof, with the roller 74 being disposed therein. The roller 74 is rotatably supported by a roller pin 104, which is inserted through a pin hole 76*b* that is substantially perpendicular to the bolt hole 100 and formed to face the cutout portion, the roller 74 being arranged so as to project outwardly with respect to the one end of the block body 98. The roller pin 104 is affixed by a pair of fixing screws 80*b* threaded into the block body 98, so that removal of the roller pin 104 from the pin hole 76*b* is prevented.

Additionally, when the block body 98 is connected to the piston rod 26, the roller 74 abuts against the guide member 72 of the housing 16, whereupon by displacement of the block body 98 in the axial direction (the direction of arrows A1 and A2), the roller 74 is displaced along the guide member 72 while the roller 74 rotates. Specifically, the roller 74 functions as a guide mechanism while the block body 98 is displaced in the axial direction (the direction of arrows A1 and A2).

On the other hand, a pin hole 76*c* substantially perpendicular to the bolt hole 100 is formed on the other end of the block body 98. A link pin 90 is inserted through the pin hole 76*c* and fixed in place by a fixing screw 80*c*. Both ends of the link pin 90, which are exposed on the outside of the pin hole 76*c*, are installed respectively into cylindrically shaped collars 92, and are inserted respectively through the link grooves 88*a*, 88*b* of the clamp arm 18.

More specifically, when the block body 98 is displaced in the axial direction under a displacement action of the piston 12 and the piston rod 26, by movement of the link pin 90 along the link grooves 88*a*, 88*b*, the clamp arm 18 is rotatably displaced through a predetermined angle about the support pin 78.

The clamp apparatus 10 according to the present invention basically is constructed as described above. Next, operations and effects of the clamp apparatus 10 shall be described.

Figure 2:
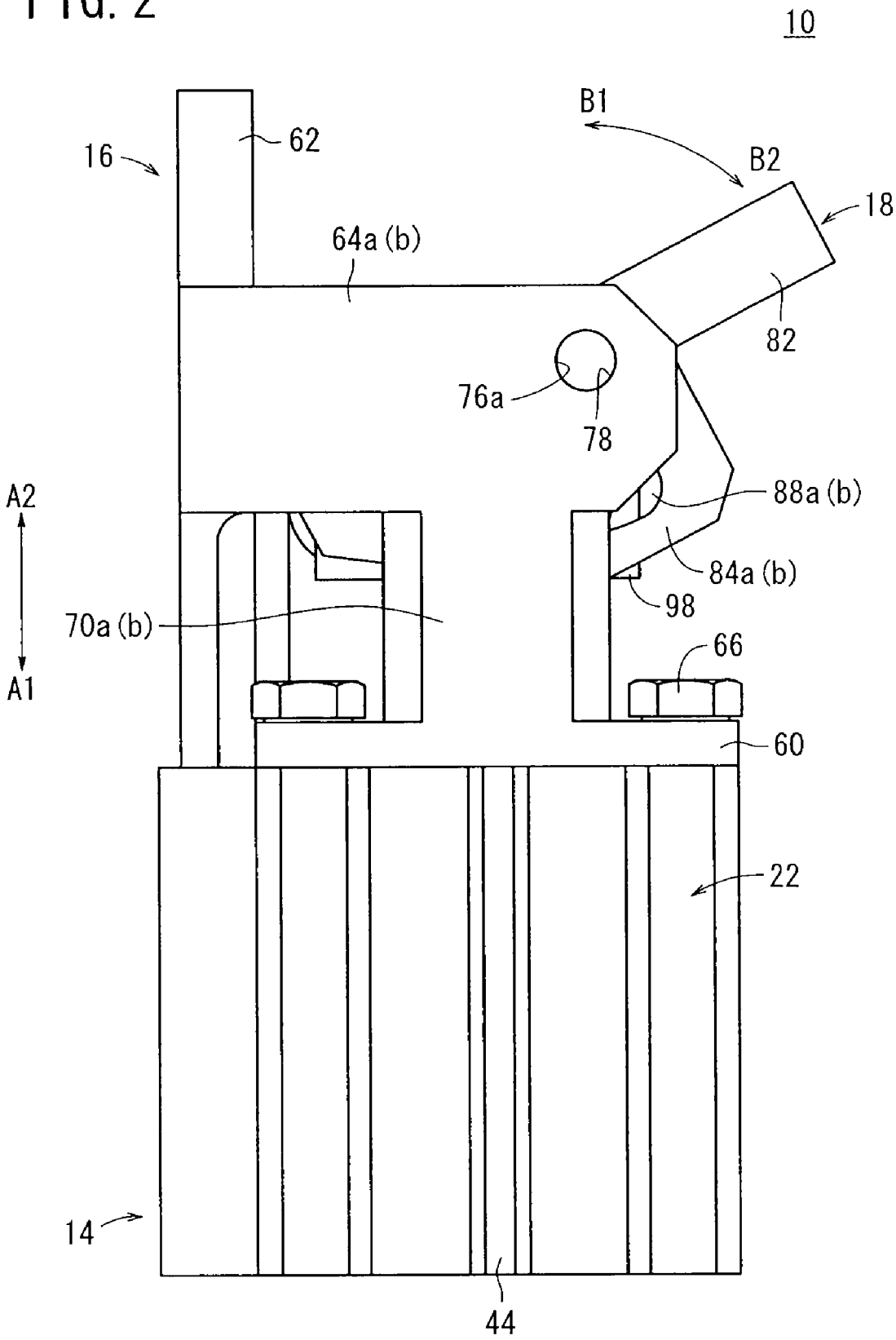
FIG. 2 is a side surface view of the clamp apparatus shown in FIG. 1.
Figure 3:
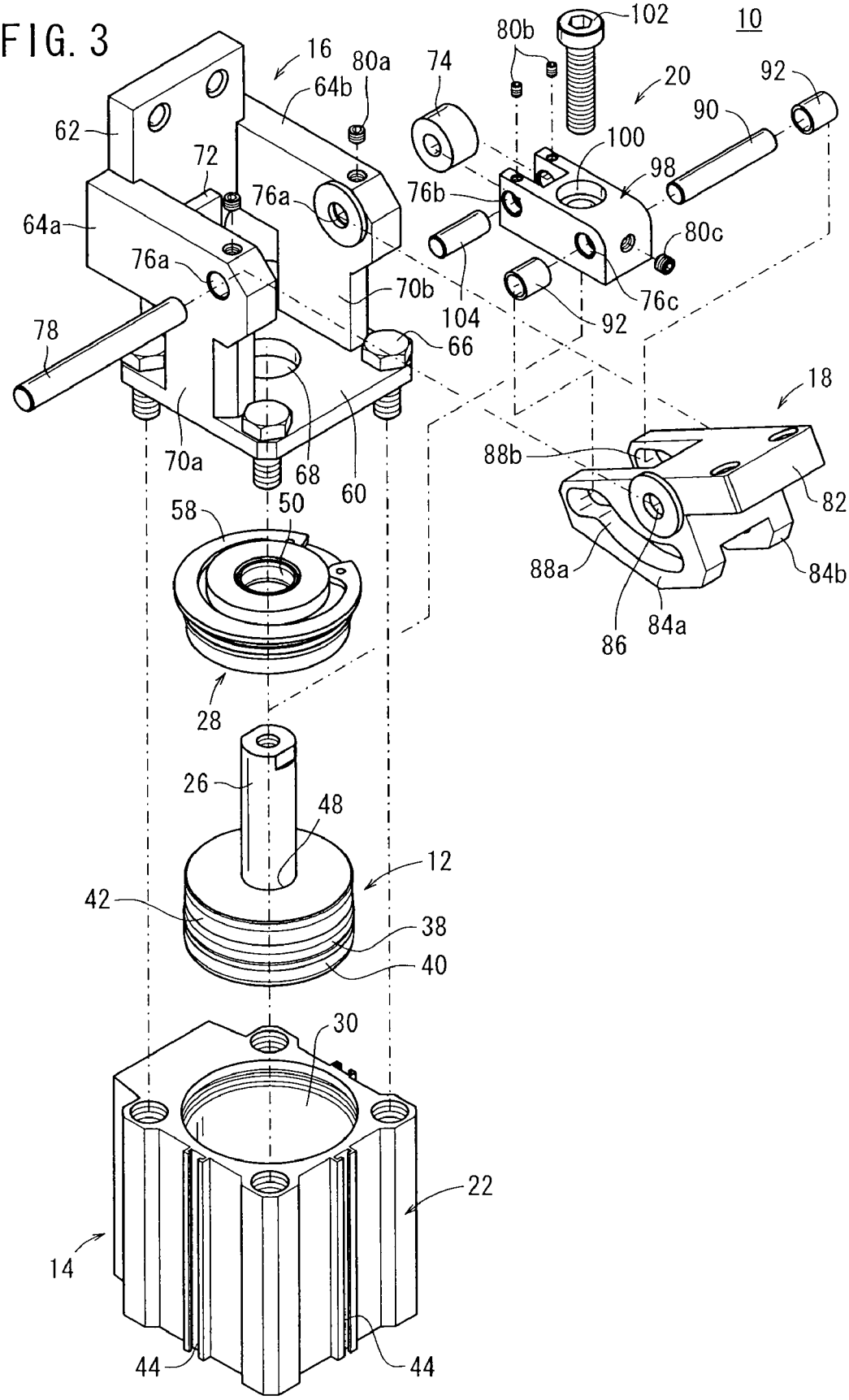
FIG. 3 is an exploded perspective view of the clamp apparatus shown in FIG. 1.
Figure 4:
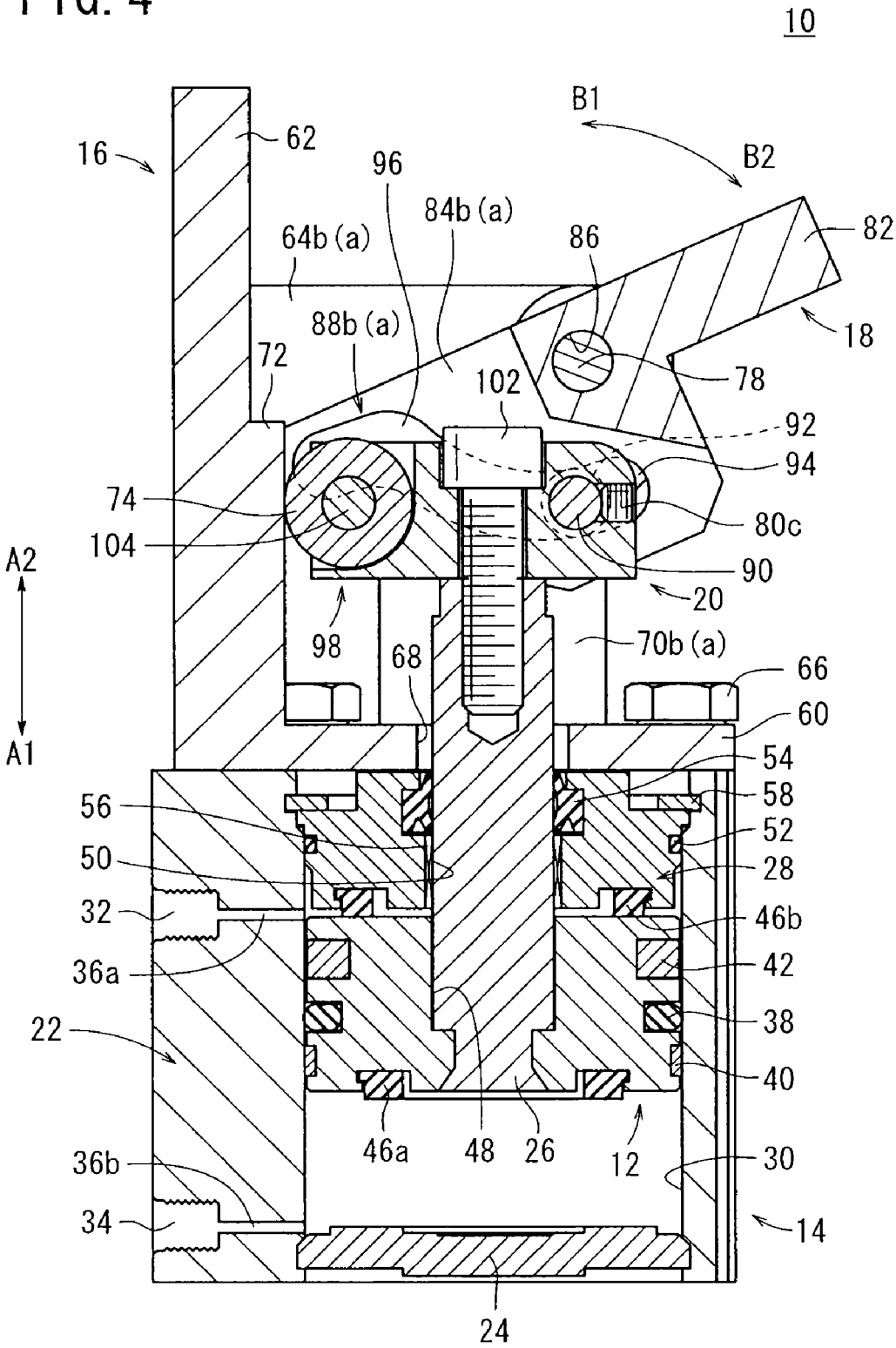
FIG. 4 is a vertical side view of the clamp apparatus shown in FIG. 2.
Figure 5:
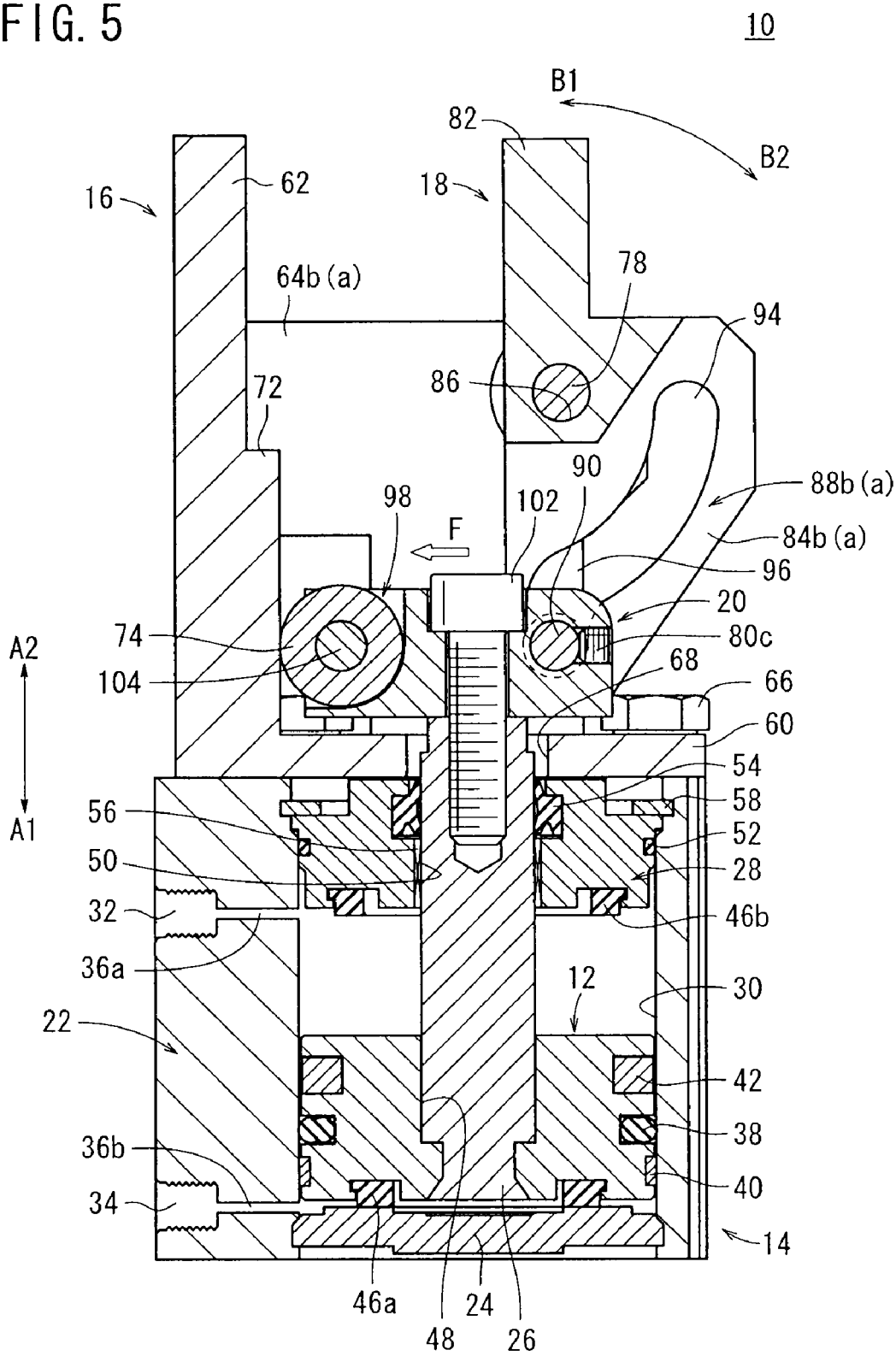
FIG. 5 is a cross sectional view showing a clamped state in which a clamp arm in the clamp apparatus of FIG. 4 is rotated for enabling a workpiece to be retained.

First, the clamp apparatus 10 is fixed at a predetermined position by a non-illustrated fixing mechanism. Unillustrated pipes or the like, which are connected to a pressure fluid supply source, are connected respectively to the first port 32 and the second port 34. FIGS. 2 and 4 show the clamp apparatus 10 in an unclamped state, whereas FIG. 5 shows the clamp apparatus 10 in a clamped state. Below, the aforementioned unclamped state shall be referred to as an initial position.

In the initial state of the clamp apparatus 10 shown in FIGS. 2 and 4, a pressure fluid is supplied to the first port 32 from an unillustrated pressure fluid supply source, and the pressure fluid is introduced into the cylinder hole 30. In this case, the second port 34 is placed in a state of being open to atmosphere.

Under an action of the pressure fluid introduced into the cylinder hole 30, the piston 12 is pressed in a direction (the direction of the arrow A1) to separate away from the housing 16, and the piston 12 descends along the cylinder hole 30. Additionally, upon displacement of the piston 12 and the piston rod 26, the block body 98 is displaced toward the side of the base member 60 (in the direction of the arrow A1) while being guided by the roller 74. In this case, the roller 74 is displaced while rotating along the guide member 72.

Linear motion of the piston 12 is transmitted to the driving force transmitting mechanism 20 through the piston rod 26, and upon displacement of the block body 98 that makes up the driving force transmitting mechanism 20, the linear motion of the piston 12 is converted into rotary motion of the clamp arm 18. Specifically, as a result of the linear motion of the piston 12, a pulling force acts in a downward direction (in the direction of the arrow A1) on the block body 98 that is connected to the piston rod 26.

In addition, by gradual movement of the link pin 90 in the link grooves 88*a*, 88*b* of the clamp arm 18 from the first link portion 94 to the second link portion 96, the clamp arm 18 is rotated gradually in an counterclockwise direction (the direction of the arrow B1) about the support pin 78, under a linking action of the link pin 90.

The clamp arm 18 is further rotated toward the side of the retaining member 62, and by becoming substantially parallel with the retaining member 62, a clamped state results in which a workpiece (not shown) is clamped, whereupon the rotational displacement of the clamp arm 18 is stopped (see FIG. 5).

At this time, magnetism from the magnet 42 is detected by a non-illustrated position detecting sensor, and together therewith, the position of the piston 12 is detected. As a result, based on the displacement position of the piston 12, the clamped state, in which the workpiece is clamped by the clamp arm 18, is confirmed.

On the other hand, in the clamp apparatus shown in FIG. 5, upon switching of a non-illustrated switchover valve, by supplying a pressure fluid to the second port 34, the piston 12 is displaced in a direction (the direction of the arrow A2) toward the side of the housing 16. Further, in this case, the first port 32 is placed in a state of being open to atmosphere. Additionally, as a result of the piston rod 26 being raised together with the piston 12, the link pin 90 that is retained in the block body 98 moves gradually from the second link portion 96 to the first link portion 94 in the link grooves 88*a*, 88*b* of the clamp arm 18, whereupon the clamp arm 18 is rotated gradually in an clockwise direction (the direction of the arrow B2) about the support pin 78, under a linking action of the link pin 90.

By abutment of the piston 12 against the damper 46*b* installed in the rod cover 28, further displacement of the piston 12 is regulated, whereupon rotational displacement of the clamp arm 18 through the piston rod 26 and the block body 98 is halted (see FIG. 4). As a result, as shown in FIGS. 2 and 4, the clamp apparatus 10 attains an unclamped state, in which the clamp arm 18 is rotated clockwise (in the direction of the arrow B2) through a predetermined angle.

At this time, by detecting displacement of the piston 12 by means of a non-illustrated position detecting sensor (not shown), the fact that the clamp arm 18 has attained the unclamped state can be confirmed based on the displacement position of the piston 12.

As described above, the block body 98 constituting the driving force transmitting mechanism 20 is connected to the piston rod 26 that makes up the cylinder mechanism 14, with a single roller 74 being rotatably disposed on an end of the block body 98. When the block body 98 is displaced along the axial direction, the roller 74 is displaced while rotating along the guide member 72, which is disposed on a side surface of the housing 16. Further, the link pin 90 that is inserted through the block body 98 is inserted, in turn, through the link grooves 88*a*, 88*b* of the clamp arm 18, which is supported on the housing 16, whereby the clamp arm 18 is rotated through a predetermined angle upon displacement of the block body 98.

More specifically, the workpiece can be clamped by a single clamp arm 18, wherein rotational movement of the clamp arm 18 is carried out via the link pin 90 provided in the block body 98, and when the clamp arm 18 is rotated, the block body 98 is capable of being guided along the axial direction (the direction of arrows A1 and A2) by means of a single roller 74.

Further, because displacement of the block body 98 in the axial direction can be guided by the guide member 72 that is disposed on the housing 16, the provision of guide grooves, as formed and used in the conventional clamp apparatus, is unnecessary.

As a result, compared to the conventional clamp apparatus, since the number of parts can be reduced, the structure of the clamp apparatus can be simplified, the steps required to assemble the clamp apparatus can be reduced, and ease of assembly thereof can also be improved.

Furthermore, in a clamped state in which a workpiece is clamped by the clamp arm 18, an opposing force F (see FIG. 5) from the clamp arm 18 is imposed in a longitudinal direction of the block body 98 through the link pin 90. At this time, because the roller 74, which is disposed on the block body 98, is supported in abutment against the guide member 72, even in the case that the opposing force F is imposed with respect to the block body 98, the block body 98 is prevented from being displaced in the longitudinal (i.e., horizontal) direction.

As a result, the block body 98 and the piston rod 26 connected to the block body 98 are not shifted eccentrically or do not become off centered in a direction perpendicular to the axis, and the clamp apparatus 10 can operate smoothly so that clamping operations on the workpiece can be performed reliably.

The clamp apparatus according to the present invention is not limited to the above-mentioned embodiment. It is a matter of course that various structures may be adopted, modified or added thereto without deviating from the essential nature and gist of the present invention.

What is claimed is:

1. A clamp apparatus in which linear movement in a cylinder is converted into rotational movement for thereby clamping a workpiece with a clamp arm, the clamp apparatus comprising:

a main body;

the cylinder connected to the main body and having a piston with a piston rod therein which is displaced along an axial direction under a pressing action of a pressure fluid;

the clamp arm retained by an attachment element to rotate with respect to the main body; and a driving force transmitting mechanism connected to said piston rod for transmitting a driving force from the cylinder to the clamp arm and causing rotational displacement of the clamp arm, wherein the driving force transmitting mechanism comprises:

a displacement member which is displaced along the axial direction together with the piston;

a guide body which rolls with respect to said displacement member being disposed on the displacement member and which abuts against a side surface of the main body such that the driving force transmitting mechanism is not inserted within the main body; and a pin member disposed on the displacement member and which is inserted through grooves of the clamp arm, wherein said guide body and said pin member remain coplanar with respect to said displacement member and said guide body and said pin member respectively while translating axially.

2. The clamp apparatus according to claim 1, wherein the displacement member extends in a direction perpendicular to the displacement direction of the piston, and wherein a substantially central portion of the displacement member is connected to a piston rod that is connected to the piston, the pin member being disposed on one end side, and the guide body being disposed on another end side of the displacement member.

3. The clamp apparatus according to claim 2, wherein the clamp arm comprises:

a clamp, which is capable of clamping the workpiece; and forked pieces disposed adjacent to the clamp, which are forked in two branches, and having the grooves therein, wherein the displacement member is arranged between one and another of the forked pieces.

4. The clamp apparatus according to claim 1, wherein the guide body comprises:

a roller rotatably supported in the displacement member, wherein the displacement member is guided by the roller facing the displacement member, and by abutment and rotational displacement of the roller against a guide member that extends along the axial direction of the main body.

5. The clamp apparatus according to claim 4, wherein the guide member prevents displacement of the displacement member in a longitudinal direction when the workpiece is clamped by the clamp arm, by means of an opposing force imparted with respect to the displacement member.

6. The clamp apparatus according to claim 4, wherein the guide member is formed in a substantially central portion of the main body.

7. The clamp apparatus according to claim 4, wherein the piston rod is connected to the displacement member at a center portion of the displacement member, the guide body being disposed on one end side of the displacement member, and the pin member being disposed on another end side of the displacement member.

8. The clamp apparatus according to claim 1, wherein the guide body includes a roller that abuts against the side surface of the main body such that the roller does not travel within a groove in the main body.

9. The clamp apparatus according to claim 1, wherein the pin member, that is disposed on the displacement member, is inserted through the grooves of the clamp arm and does not extend into a groove in the main body.

10. The clamp apparatus according to claim 1, wherein the displacement member is attached to the piston such that the displacement member moves in the axial direction without rotating.

11. A clamp apparatus for clamping a workpiece, comprising:

a main body;

a cylinder connected to the main body and having a piston with a piston rod therein which is displaced along an axial direction;

a clamp arm retained by an attachment element to rotate with respect to the main body; and a driving force transmitting mechanism connected to said piston rod and configured to transmit a driving force from the cylinder to the clamp arm and cause rotational displacement of the clamp arm, wherein the driving force transmitting mechanism comprises:

a displacement member attached to the piston to be displaced in the axial direction without rotating;

a guide body which rolls with respect to said displacement member being disposed on the displacement member and which abuts against a side surface of the main body such that the driving force transmitting mechanism is not inserted within the main body; and a pin member disposed on the displacement member and which is inserted through grooves of the clamp arm, wherein said guide body and said pin member remain coplanar with respect to said displacement member and said guide body and said pin member respectively while translating axially.

12. The clamp apparatus according to claim 11, wherein the guide body comprises:

a clamp, which is capable of clamping the workpiece; and forked pieces disposed adjacent to the clamp, which are forked in two branches, and having the grooves therein, wherein the displacement member is arranged between one and another of the forked pieces.

13. The clamp apparatus according to claim 11, wherein the guide body includes a roller that abuts against the side surface of the main body such that the roller does not travel within a groove in the main body.

14. The clamp apparatus according to claim 11, wherein the pin member that is disposed on the displacement member inserted through the grooves of the clamp arm does not extend into a groove in the main body.

* * * * *